US005305290A

United States Patent [19]

Yoo

[11] Patent Number: 5,305,290

[45] Date of Patent: Apr. 19, 1994

[54] DOUBLE-FACED CLOCK HAVING A DEVICE FOR ADJUSTING A TIME DIFFERENCE

[76] Inventor: Won G. Yoo, 53 Yea Ji-Dong, JongRo-Ku, Seoul, Rep. of Korea

[21] Appl. No.: 41,168

[22] Filed: Apr. 1, 1993

[30] Foreign Application Priority Data

Apr. 20, 1992 [KR] Rep. of Korea ..... 92-7227

[51] Int. Cl.[5] ..... G04B 19/00; G04B 19/04

[52] U.S. Cl. ..... 368/76; 368/80; 368/223; 368/228

[58] Field of Search ..... 368/76, 80, 223, 228, 368/185, 190

[56] References Cited

U.S. PATENT DOCUMENTS 1,432,566 10/1922 Metcalfe .
1,850,184 3/1932 Spainhower .
2,243,343 5/1941 Johnson ..... 368/228
3,106,817 10/1963 Dulommun ..... 368/76
4,370,063 1/1983 Lee ..... 368/71
4,720,820 1/1988 Siefert ..... 368/76

*Primary Examiner*—Vit W. Miska
*Attorney, Agent, or Firm*—Stevens, Davis, Miller & Mosher

[57] ABSTRACT

A double-faced clock having a device for adjusting time difference between two clock part. The double-faced clock comprising a first clock part containing a first gear group for operating hands of clock, a second clock part attached to a rear side of the first clock part which contains a second gear group similar to the first gear group, a driving shaft rotatably supported in the first and second clock parts and driven by a driving source which is mounted with a first driving gear engaging with any gear of the first gear group at its first end and which is mounted with a second driving gear engaging with any gear of the second gear group at its second end, and means for adjusting selectively time of one or both of the first and second clock parts.

5 Claims, 5 Drawing Sheets

DOUBLE-FACED CLOCK HAVING A DEVICE FOR ADJUSTING A TIME DIFFERENCE

BACKGROUND OF THE INVENTION

1. Field of the Invention

The present invention relates to a double-faced clock capable of indicating domestic and foreign times different from each other at its both sides, and more particularly to a double-faced clock having two clock parts which has a device adapted to adjust one of the two times while maintaining the other time and which is more slimmed in thickness.

2. Description of The Prior Art

A general clock can indicate a time at its only one side so that it can not show a time to many people simultaneously. In order to overcome the above-mentioned disadvantage, there is well known a clock which indicates a time at its both sides.

The known clock comprises two clock parts which show a time in the opposite directions and which are attached to each other with a central division plate interposed therebetween. One of the two clock parts contains the same gear group as that of the other clock part to rotate the hands of the clock parts. One of the gear groups of clock parts is engaged with and driven by a driving gear. A shaft of the driving gear is extended rearward beyond the central division plate and a driving gear mounted on the other end of the shaft is engaged with and drives the other gear group.

The known clock is driven by rotation of the driving shaft so that the two clock parts show an identical time with each other at the opposite sides. Accordingly, the known clock can not indicate times of two countries different from each other but indicate only one time at its both sides.

Recently, as cultural and economic exchanges and a trip abroad are progressively activated, it is necessary to observe times of two or more countries simultaneously. For that purpose, it is general that user must purchase two or more clocks separately and then observe the clocks alternatively.

In addition, there has been proposed an all nations' clock which has a rotating time displaying disk on which names of a plurality of countries or capitals are printed at its circumference. However, it is difficult to read a time of certain country in the all nations' clock. That is, since a plurality of country's names are arranged on the time displaying disk, it is considerably confused that which of the country's names must be standardized to read a time of given country. Furthermore, since hour, minute and second hands of the clock are entangled with the plurality of country's names and hour marks (i.e., 1, 2, 3, - - - ), it is required great skill to read a given time.

SUMMARY OF THE INVENTION

The present invention has been made in view of the above-described prior art problems and an object of the invention is to provide a double-faced clock which can indicates times of two countries at its both sides.

Another object of the invention is to provide a double-faced clock which has a device for adjusting a time of either of two clock parts while maintaining the time of the other clock part.

Still another object of the invention is to provide a double-faced clock which is considerably slimmed as compared with a conventional clock.

In accordance with the present invention, the object mentioned above can be accomplished by providing a double-faced clock comprising: a first clock part containing a first gear group for operating hands of clock; a second clock part attached to a rear side of the first clock part which contains a second gear group similar to the first gear group; a driving shaft rotatably supported in the first and second clock parts and driven by a driving source which is mounted with a first driving gear engaging with any gear of the first gear group at its first end and which is mounted with a second driving gear engaging with any gear of the second gear group at its second end; and means for adjusting selectively time of one or both of the first and second clock parts.

In accordance with an aspect of the invention, the first driving gear is fixedly mounted on the first end of the driving shaft, the second gear is rotatably and slidably mounted on the second end of the driving shaft, and the means comprises a compression spring disposed between the first and second driving gear to bias the second driving gear outward, a stop pin fixed to the second end of the driving shaft and adapted to provide the second driving gear with a frictional force and a knob secured to the outer surface of the second driving gear and projected from an outer case of the second clock part, the knob having a reception recess for receiving the stop pin and the second end of the driving shaft.

In accordance with another aspect of the invention, the first driving gear is fixedly mounted on the first end of the driving shaft, the second gear is rotatably mounted on the second end of the driving shaft through its center hole, and the means comprises a ratchet gear in an annular groove formed on the second end of the driving shaft, a plurality of boss segments provided at a circumference of the center hole and projected axially on which grooves are formed and a retaining ring disposed in the grooves of the boss segments which is provided at its inner surface with a plurality of pawls engaging with the ratchet gear.

In accordance with still another aspect of the invention, the first driving gear is fixedly mounted on the first end of the driving shaft, the second gear is rotatably and slidably mounted on the second end of the driving shaft, and the means comprises a first ratchet gear formed at an inner surface of the first driving gear, a second ratchet gear formed at an inner surface of the second driving gear which is engaged with the first ratchet gear and a spring for biasing the second driving gear inward.

In accordance with still another aspect of the invention, the first and second driving gears are fixedly mounted on the first and second ends of the driving shaft, and the means comprises a sliding gear slidably inserted on a pin secured to the inner case of the second clock part which is always engaged with the second driving gear and selectively engaged with any gear of the second gear group when the sliding gear is moved outward, an actuating rod projected from the second clock part at its outer end which has a bevel gear engaging with the sliding gear at its inner end, a lever connected to the actuating rod at its end and disposed between the sliding gear and the inner case of the second clock part at its other end which is adapted to move the sliding gear outward when the actuating rod is pulled outward and a spring for biasing the sliding gear inward.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Various embodiments according to double-faced clock of the present invention will now be described by referring to the accompanying drawings.

Figure 1:
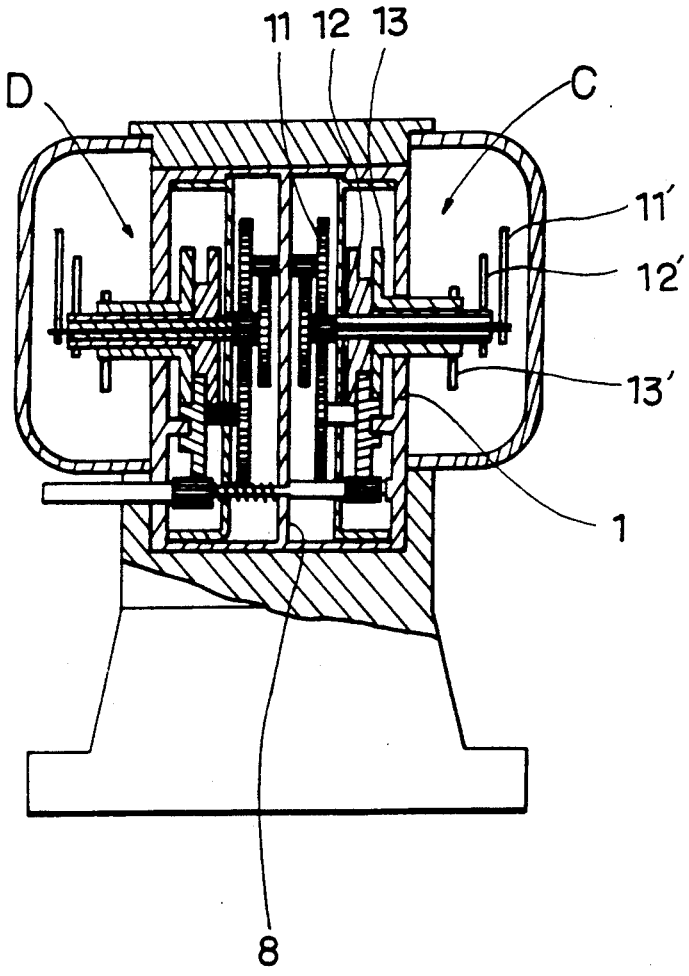
FIG. 1 is a sectional view of a double-faced clock utilizing a device according to a first embodiment of the present invention.

Referring to FIG. 1, there is shown a double-faced clock having a device for adjusting a time difference according to an embodiment of the invention. As shown in the drawing, the double-faced clock 14 comprises a first clock part (a domestic clock part) 14*a* and a second clock part (a foreign clock part) 14*b* with a central division plate 8 therebetween. The clock parts 14*a* and 14*b* each contains a gear group consisting of a second gear 11, a minute gear 12 and a hour gear 13 within a case 1. The gears 11, 12 and 13 are connected to a second hand 11', a minute hand 12' and a hour hand 13' respectively. The first and second gear groups are engaged with a first intermediate gear 15 and a second intermediate gear 16. The intermediate gears 15 and 16 are engaged with a first driving gear 2 and a second driving gear 4 respectively. The driving gears 2 and 4 are mounted on the opposite ends of a driving shaft 3 which is connected to and rotated by a driving source (not shown). Accordingly, the first and second clock parts 14*a* and 14*b* are operated by a single driving shaft 3 so that the first clock part 14*a* simultaneously indicate the same time as that of the second clock part 14*b*. The above-mentioned structure of the double-faced clock is substantially equal to a conventional one.

Figure 2:
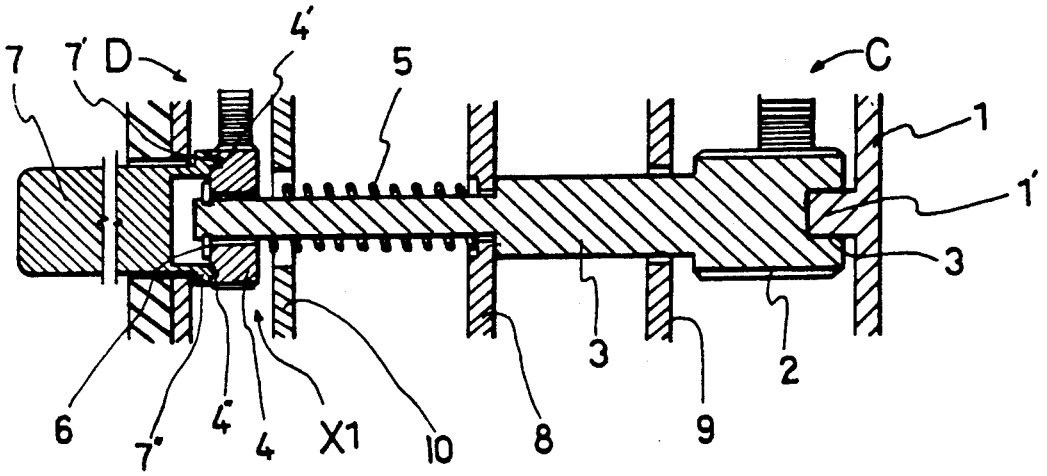
FIG. 2 is an enlarged sectional of the device of FIG. 1 which is in a normal condition.
Figure 3:
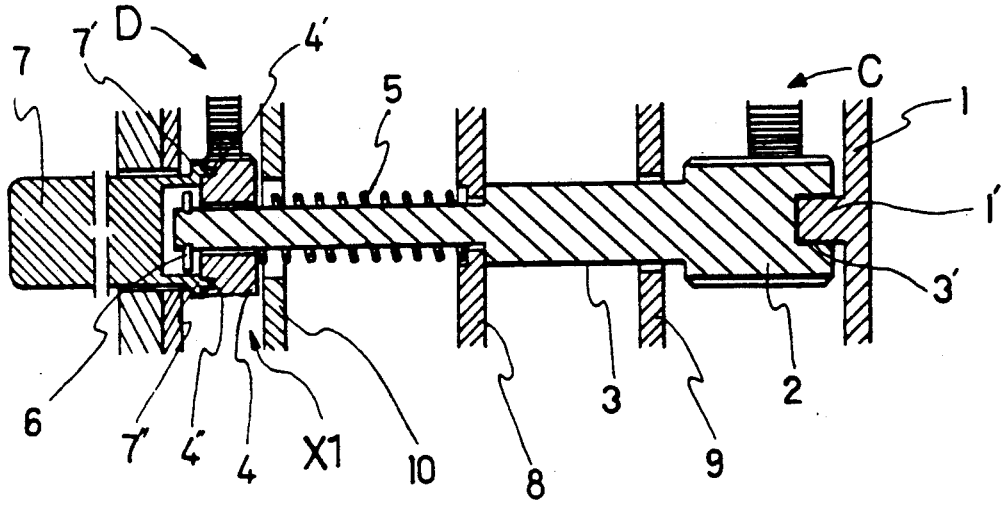
FIG. 3 is a view similar to FIG. 2 which is in an operating condition.

Referring to FIGS. 2 and 3, there are shown a device for adjusting a time difference between the first and second clock parts according to the present invention. As described in the FIG. 1, the adjusting device of the invention comprises the driving shaft 3 and the first and second driving gears 2 and 4 mounted on the opposite ends of the driving shaft 3. The first driving gear 2 is fixedly mounted on an end of the driving shaft 3. The driving gear 3 passes through a first supporting plate 9 of the first clock part 14*a*, the central division plate 8 and a second supporting plate 10 of the second clock part 14*b* and is rotatably supported therein. Also, the driving shaft 3 is formed with a supporting hole 3' at the center of the end thereof and the case 1 is provided with a projected pin 1' at a position corresponding to the supporting hole 3' of the driving shaft 3, thereby allowing the driving shaft 3 to be rotated about the projected pin 1'.

In accordance with the invention, the second driving gear 4 is slidably and rotatably mounted on the other end of the driving shaft 3. A compression spring 5 is disposed between the second driving gear 4 and the central division plate 8 to bias the second driving gear 4 outward such that the spring 5 can pass through the second supporting plate 10 without interference with the second supporting plate 10. A stop pin 6 is fixed to the other end of the driving shaft 3 and engaged with the outer surface of the second driving gear 4. The second driving gear 4 is formed with a plurality of circumferential fitting holes 4' at its outer surface.

A knob 7 adapted to be coupled to the second driving gear 4 is provided with the plurality of fitting projections 7' at its inner end and formed with a reception opening 7*a* at the center of its inner end to receive somewhat the stop pin 6 and the other end of the driving shaft 3. The knob 7 is projected from the case 1 at its outer end and coupled to the second driving gear 4 by the fitting the projections 7' into the holes 4.

The operation of the double-faced clock according to the first embodiment of invention will be described as follows.

In ordinary condition, the second driving gear 4 is frictionally engaged between the stop pin 6 and the compression spring 5 due to the biasing force of the spring 5 (see FIG. 2). As the driving shaft 3 is rotated by the driving source, the second driving gear 4 is rotated together with the first driving gear 2 so that the first and second gear groups are operated simultaneously, thereby operating the hands of the first and second clocks. Therefore, the first and second clock parts 14*a* and 14*b* indicate two kinds of times with a predetermined time difference therebetween. At this time, as the knob 7 is rotated by user's fingers in order to set the times of the first and second clock parts 14*a* and 14*b*, the second driving gear 4 coupled to the knob 7 is rotated and also the first driving gear 2 is rotated by engagement with the stop pin 6. Accordingly, the first and second gear groups are rotated so that the times of the first and second clock parts 14*a* and 14*b* are adjusted in accordance with the rotating amount of knob 7.

When a time difference error occurs in the second clock part 14*b* relative to the first clock part 14*a*, it is necessary to adjust a time difference between the first and second clock parts 14*a* and 14*b*, the knob 7 is pushed by user's fingers. The second driving gear 4 is then disengaged from the stop pin 6 and slid along the driving shaft 3 (see FIG. 3). Thereafter, upon rotating the knob 7, the knob 7 rotates the second driving 4 but does not rotate the first driving gear 2 because the first driving gear 4 is disengaged from the stop pin 6 and freely rotated relative to the driving shaft 3. That is, the second driving gear 4 is rotated by the rotation of the knob 7 while the first driving gear 2 is normally rotated by the driving source. Consequently, since the second gear group is operated separately from the first gear group, it is possible to adjust a time difference between the first and second clock parts 14*a* and 14*b*.

After the adjustment of time difference, the knob 7 is released from user's fingers. Then, the second driving gear 4 is biased toward and again engaged with the stop pin 6 by means of the compression spring 5 (see FIG. 2). Therefore, both of the first and second clock parts 14*a* and 14*b* are normally operated by the driving shaft 3.

As described above, the first and second clock parts 14*a* and 14*b* of the double-faced clock of the invention are normally operated by the first and second driving gears 2 and 4 which rotate at the same rotative speed in an ordinary use while the second clock part 14*b* is operated separately from the first clock part 14*a* by the rotation of knob 7 when it is necessary to adjust a time difference therebetween. Therefore, the double-faced clock of the invention can be used as a clock for two countries and adjusted in a time difference therebetween, if required.

Figure 4:
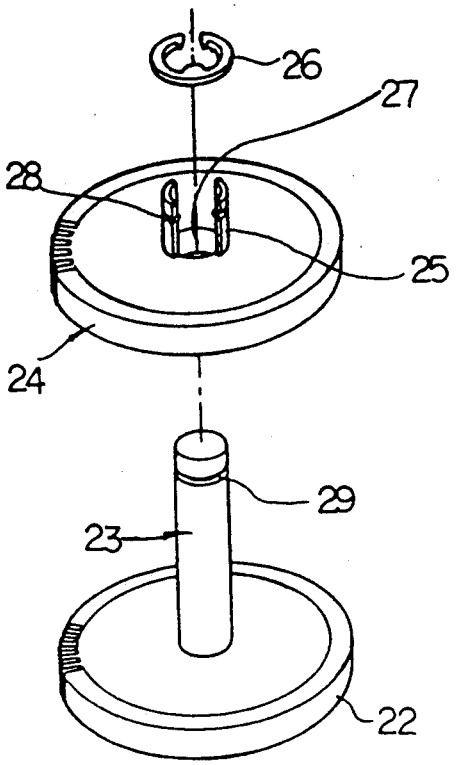
FIG. 4 is an exploded perspective view of a device according to a second embodiment of the invention.

Referring to FIG. 4, there is shown a device for adjusting a time difference of a second embodiment of the invention. As shown in the drawing, the device comprises a driving shaft 23 and first and second driving gears 22 and 24 mounted on the opposite ends of the driving shaft 23 similarly to the first embodiment shown in FIGS. 1 to 3. The first driving gear 22 is fixedly mounted on an end of the driving shaft 23. The driving shaft 23 is formed with an annular groove 29 at an outer surface of the other end and the annular groove 29 is formed with a ratchet gear (not shown) at its bottom.

The second driving gear 24 is formed with a center hole 27 to be inserted by the driving shaft 23 so that it is rotatably mounted on the driving shaft 23. The second driving gear 24 is provided at a circumference of the center hole 27 with a plurality of boss segments 25 outward projecting therefrom. The boss segments 25 are formed with grooves 28 at outer surfaces thereof. The second driving gear 24 is inserted on the driving shaft 23 such that the grooves 28 of the boss segments 25 are flushed with the annular groove 29 of the driving shaft 23. A retaining ring 26 is engaged with the grooves 28 of the boss segments 25. The retaining ring 26 is provided with a plurality of pawls 26*a* at its inner surface. The pawls 26*a* of the retaining ring 26 are engaged with the ratchet gear of the annular groove 29 when the device is fully assembled. Therefore, when the first driving gear 22 is normally rotated in a certain rotating direction, the second driving gear 24 is also rotated in the rotating direction by cooperation of the ratchet gear of the groove 29 with the pawls 26*a*. However, when the second driving gear 24 is forcibly rotated in the rotating direction by user, the second driving gear 24 is disengaged from the ratchet gear of the groove 29 and slidably rotated on the driving shaft 23 separately from the first driving gear 22.

Operation of the second embodiment will be now described. When it is necessary to adjust times of the first and second clock parts 14*a* and 14*b* simultaneously, the second driving gear 24 is forcibly rotated in the reverse rotating direction opposite to the normal direction by user. Consequently, the first and second driving gears 14*a* and 14*b* operate reversely the first and second gear groups at the same rotative speed to adjust both times of the first and second clock parts 14*a* and 14*b*.

On the other hand, when it is necessary to adjust only a time of the second clock part 14*b* so as to adjust a time difference between the first and second clock parts, the second driving gear 24 is forcibly rotated in the normal rotating direction by user. Hence, the pawls 26*a* of the retaining ring 26 are disengaged from the driving shaft 23 and rotated separately from the first driving gear 22 so that the only the time of second clock part 14*b* is adjusted while the first clock part 14*a* operates normally.

Figure 5A:
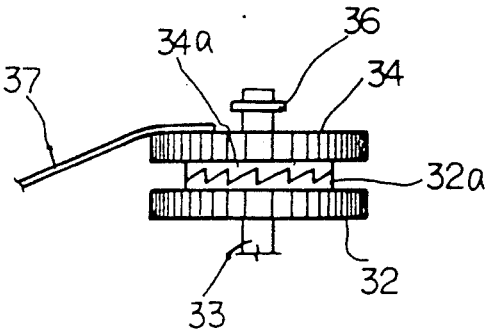
FIG. 5*a* is a side view of a device according to a third embodiment of the invention which is in normal condition.
Figure 5B:
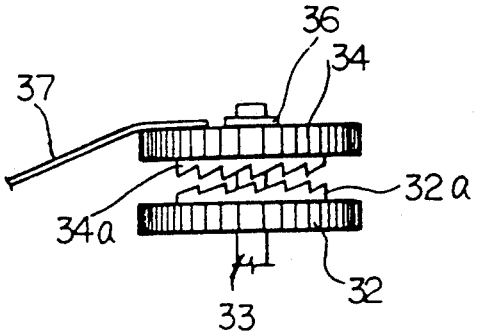
FIG. 5*b* is a view similar to FIG. 5*a* which is in an operating condition.

Referring to FIGS. 5*a* and 5*b*, there are shown a device for adjusting a time difference according to a third embodiment of the invention. The device comprises a driving shaft 33, a first driving gear 32 fixed to an end of the driving shaft 33 and a second driving gear 34 rotatably mounted on the other end of the driving shaft 33. A stop ring 36 is fixed to a distal end of the driving shaft 33 to prevent the second driving gear 34 from being separated from the driving shaft 33. The first driving gears 32 is provided with a ratchet gear 32*a* at its inner surface and the second driving gear 34 is also provided with a ratchet gear 34*a* corresponding to the ratchet gear 32*a* at its inner surface. A leaf spring 37 is secured to the case 1 at its end. The other end of the leaf spring 37 contacts an outer surface of the second driving gear 34 to bias the second driving gear 34 inward.

In operation of the third embodiment, the first driving gear 32 together with the second driving gears 34 are rotated in a normal rotating direction by engagement of the ratchet gears 32*a* and 34*a* during normal operation. When it is necessary to adjust only a time of the second clock part 14*b*, the second driving gear 34 is forcibly rotated in the normal direction by user. Then, the ratchet gear 34*a* of the second driving gear 34 is disengaged from the ratchet 32*a* of the first driving gear 32 and the second driving gear 34 is pushed outward against the biasing force of the leaf spring 37 so that the second driving gear 34 is rotated separately from the first driving gear 32, thereby adjusting only a time of the second clock part 14*b*. After the adjustment of the second clock part, upon being released from user, the second driving gear 34 is moved toward the first driving gear 32 by the biasing force of the leaf spring 37. Then, the ratchet gear 34*a* of the second driving gear 34 is again engaged with the ratchet gear 32 of the first driving gear 32 so that the second driving gear 34 is normally rotated together with the first driving gear 32.

As described in the second and third embodiments, since the devices utilize ratchet mechanism without the compression spring of the first embodiment, the distance between the first and second driving gears can be reduced. Accordingly, the devices are appropriate to slim and lighten the clocks.

Referring to FIGS. 6*a* to 8, there are shown a device for adjusting a time difference according to fourth embodiment of the invention. The double-faced clock comprises a first clock part 40*a* and a second clock part 40*b*. The first clock parts 40*a* contains the same gear group as that in the second clock part 40*b*. The second clock part 40*b* has an inner case 50 and an outer case 51. A pair of hook arms 57 are attached to both sides of the outer case 51 at ends thereof and grip the first clock part 40*a* at the other ends thereof so that the second clock part 40*b* is detachably jointed to the first clock part 50. A second driving gear 56 is projected from an inner case of the first clock part 40*a* and inserted into a hole 57 of the inner case 50 of the second clock part 40*b* (see FIG. 7).

Figure 8:
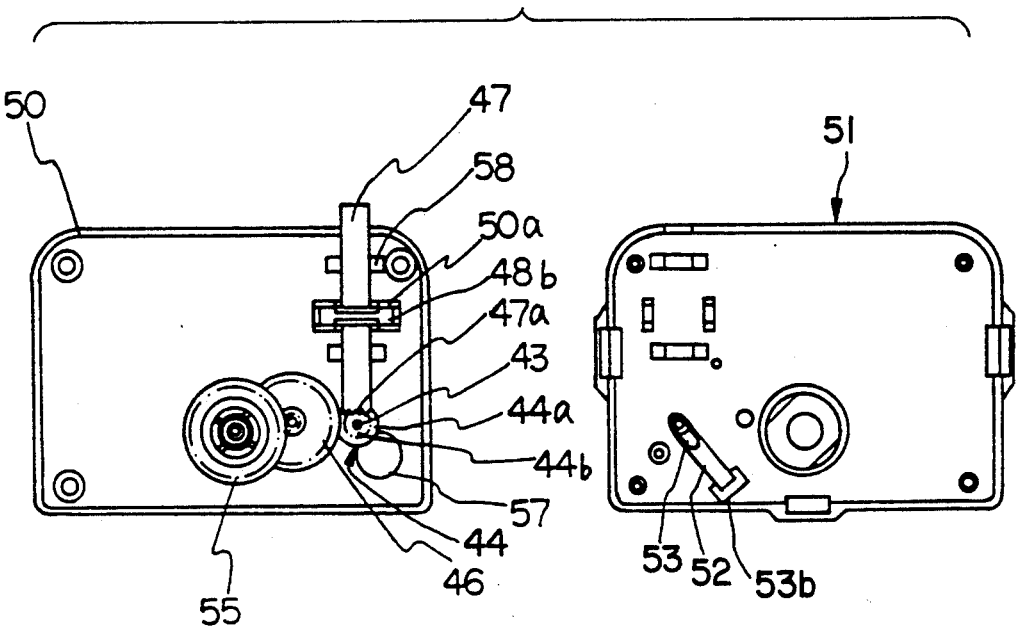
FIG. 8 is a front view of a second clock part in FIG. 7 in which an outer case is removed.

As shown in FIG. 8, the second driving gear 56 is engaged with a sliding gear 44. The sliding gear 44 is rotatably supported on a support pin 43 and axially movable. The sliding gear 44 comprises an inner larger gear 44*a* engaging with an intermediate gear 46 and an outer smaller gear 44*b*. The intermediate gear 46 is engaged with a hand gear 55. The inner case 50 is provided with a pair of supporting projections 58 at its inner surface and also the outer case 51 is provided with a pair of supporting projections 58 corresponding to the pair of projections of the inner case 50. The supporting projections 58 each is formed with a semicircular recess so that the recess of the supporting projection 58 of the inner case 50 forms a perfect circular hole together with the recess of the supporting projection 58 of the outer case 51 when the inner and outer cases 50 and 51 are assembled each other.

An actuating rod 47 is inserted into the holes defined by the recess of supporting projections 58 of the inner and outer cases 50 and 51. The actuating rod 47 is provided with a pair of flanges 47*b* to form an annular groove therebetween and formed with a bevel gear 47*a* facing downward at its lower end. The bevel gear 47*a* is engaged with the outer smaller gear 44*b* of the sliding gear 44. The inner case 50 is provided with a pair of elongated protrusions 50*a* at its inner surface between the pair of supporting projections 58 to form a groove therebetween. The lower protrusion of the elongated protrusions 50*a* is cut at its middle portion.

A shifting lever 48 is disposed between the actuating rod 47 and the inner case 50. The shifting lever 48 is provided at its upper end with a pair of hinge pins 48*b* projecting oppositely therefrom and provided at the upper end with an arm 48*a* projecting outward at a right angle relative to the shifting lever 48. The hinge pins 48*b* of the shifting lever 48 is disposed between the elongated protrusions 50*a* so that the shifting lever 48 is pivotally mounted between the protrusions 50*a*. The arm 48*a* of the shifting lever 48 is disposed between the flanges 47*b* of the actuating rod 47 and the lower end of the shifting lever 48 is disposed between the sliding gear 44 and the inner case 50. A leaf spring 52 is secured to a spring support 53 formed at the outer case 51. The free end of the leaf spring 52 contacts the outer surface of the sliding gear 44 to bias the sliding gear 44 inward.

Figure 6A:
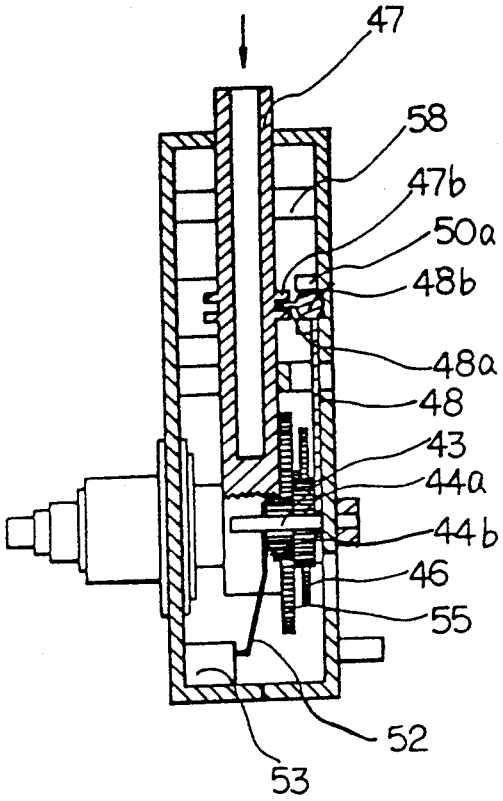
FIG. 6*a* is a sectional view of a clock utilizing a device according to a fourth embodiment of the invention which is in normal condition.
Figure 6B:
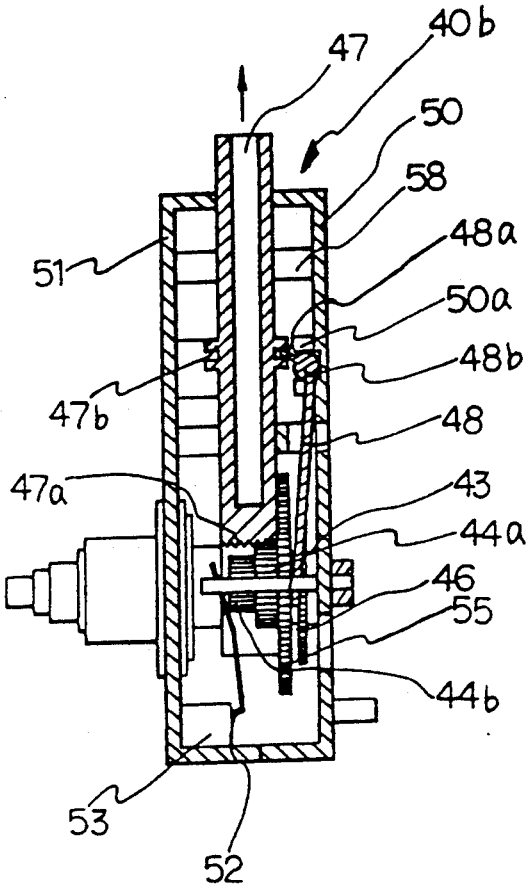
FIG. 6*b* is a view similar to FIG. 6*a* which is in an operating condition.
Figure 7:
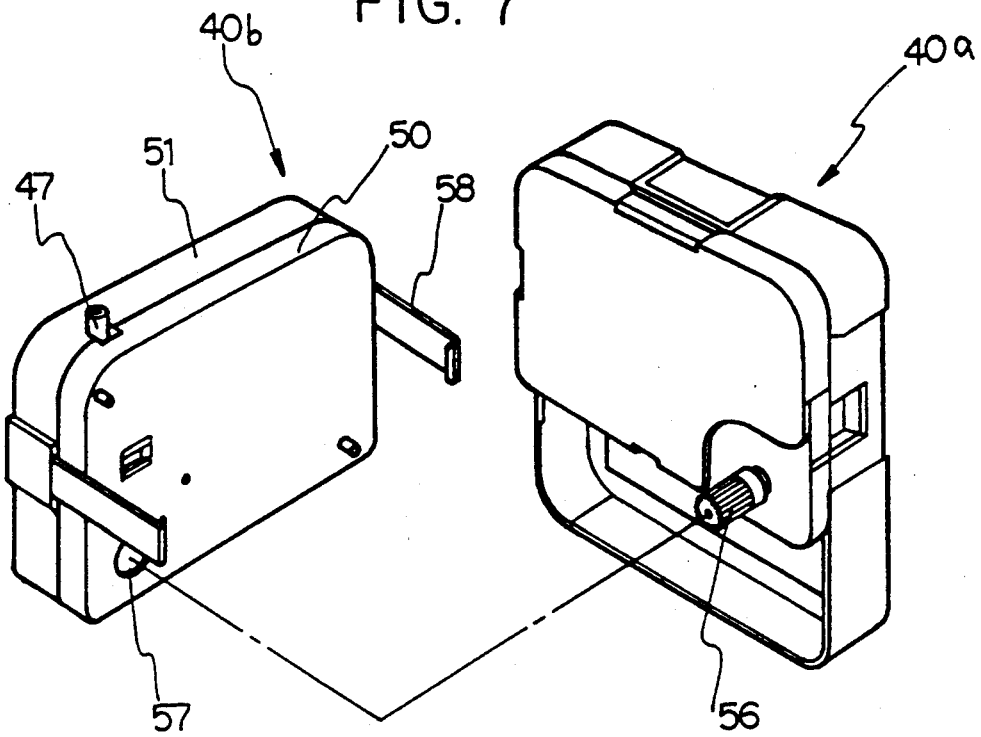
FIG. 7 is an exploded perspective view of a clock utilizing a device of FIGS. 6*a* and 6*b*.

The operation of the double-faced clock according to the fourth embodiment of invention will be now described with reference to FIGS. 6*a* and 6*b*. In normal operation shown in FIG. 6*a*, since the sliding gear 44 is located in inward moved position by the leaf spring 52 and engaged with the intermediate gear 46 and the second driving gear 56 (not shown in FIGS. 6*a* and 6*b*) at its inner larger gear 44*a*, the rotating force of the second driving gear 56 is transmitted to the hand gear 55 through the sliding gear 44 and the intermediate gear 46. Therefore, the first and second clock parts 40*a* and 40*b* operate normally. At this time, when it is necessary to adjust both times of the first and second clock parts 40*a* and 40*b* simultaneously, the actuating rod 47 is rotated in an optional direction by user's fingers. Upon rotating the actuating rod 47, the sliding gear 44 is rotated so that the sliding gear 44 rotates the intermediate gear 46 and the second driving gear 56. Consequently, since the second gear group is operated together with the first gear group, both times of the first and second clock parts 40*a* and 40*b* are adjusted simultaneously.

On the other hand, when it is necessary to adjust only time of the first clock part 40*a* so as to provide a certain time difference therebetween, the actuating rod 47 is first pulled out of the cases 50 and 51. Then, the flanges 47*b* of the actuating rod 47 pulls the arm 48*a* of the lever 48 so that the lower end of the lever 48 is pivoted outward. Due to the outward pivoting motion of lever 48, the sliding gear 44 is moved outward along the support pin 43 against the biasing force of the leaf spring 52 while the inner larger gear 44*a* is engaged with the second driving gear 56. Consequently, the inner larger gear 44*a* of the sliding gear 44 is disengaged with the intermediate gear 46 but is still engaged with the second driving gear 56 so that the rotating force of the second driving gear 56 is not transmitted to the second gear group any more.

Under this condition, the actuating rod 47 is rotated in an optional direction to cause the sliding gear 44 to be rotated. The sliding gear 44 rotates only the second driving gear 56 but can not rotate the intermediate gear 46 of the second clock part 40*b*, thereby cause only the first clock part 40*a* to be operated. Therefore, a time of the first clock part 40*a* is adjusted while a time of the second clock part 40*b* is stopped.

Thereafter, the actuating rod 47 is released from user's fingers so that the sliding gear 44 is moved inward along the supporting pin 43 by the biasing force of the leaf spring 52. Due to the inward movement of the sliding gear 44, the lever 48 is pivoted inward so that the arm 48*a* of the lever 48 pulls the actuating rod 47 downward. Then, the inner larger gear 44*a* of the sliding gear 44 is again engaged with the intermediate gear 46 to allow the rotating force of the second driving gear 56 to be transmitted to the intermediate gear. Therefore, both of the first and second clock parts 40*a* and 40*b* are again operated normally.

As apparent from the above description, since the double-faced clock according to the present invention has a device which can adjust a time of any of both clock parts but does not affect operation of the other clock part, the double-faced clock of the invention can adjust a time difference between both of the first and second clock parts. In addition, since the driving shaft illustrated in FIGS. 4 to 8 is considerably shortened, the double-faced clock of the invention can be slimmed. Therefore, the device shown in FIGS. 1 to 3 is appropriate to a large-sized clock and the device shown in FIGS. 4 to 8 is appropriate to a small-sized clock.

Although the embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A double-faced clock having a device for adjusting a time difference comprising:

a first clock part containing a first gear group for operating hands of clock;

a second clock part attached to a rear side of the first clock part which contains a second gear group similar to the first gear group;

a driving shaft rotatably supported in the first and second clock parts and driven by a driving source which is mounted with a first driving gear engaging with any gear of the first gear group at its first end and which is mounted with a second driving gear engaging with any gear of the second gear group at its second end; and means for adjusting selectively time of one or both of the first and second clock parts.

2. A double-faced clock in accordance with claim 1, wherein said first driving gear is fixedly mounted on the first end of the driving shaft, said second gear is rotatably and slidably mounted on the second end of the driving shaft, and said means comprises a compression spring disposed between the first and second driving gear to bias the second driving gear outward, a stop pin fixed to the second end of the driving shaft and adapted to provide the second driving gear with a frictional force and a knob secured to the outer surface of the second driving gear and projected from an outer case of the second clock part, the knob having a reception recess for receiving the stop pin and the second end of the driving shaft, whereby when the knob is pushed inward and rotated, the second driving gear is disengaged from the stop pin and rotated separately from the first driving gear so that the rotation of the second driving gear operates the second gear group but does not operate the first gear group.

3. A double-faced clock in accordance with claim 1, wherein said first driving gear is fixedly mounted on the first end of the driving shaft, said second gear is rotatably mounted on the second end of the driving shaft through its center hole, and said means comprises a ratchet gear in an annular groove formed on the second end of the driving shaft, a plurality of boss segments provided at a circumference of the center hole and projected axially on which grooves are formed and a retaining ring disposed in the grooves of the boss segments which is provided at its inner surface with a plurality of pawls engaging with the ratchet gear, whereby when the second driving gear is rotated in a reverse rotating direction, the pawls are disengaged from the ratchet gear and rotated separately from the first ratchet gear so that the rotation of the second driving gear operates the second gear group but does not operate the first gear group.

4. A double-faced clock in accordance with claim 1, wherein said first driving gear is fixedly mounted on the first end of the driving shaft, said second gear is rotatably and slidably mounted on the second end of the driving shaft, and said means comprises a first ratchet gear formed at an inner surface of the first driving gear, a second ratchet gear formed at an inner surface of the second driving gear which is engaged with the first ratchet gear and a spring for biasing the second driving gear inward, whereby when the second driving gear is rotated in a reverse rotating direction, the second ratchet gear is disengaged from the first ratchet gear and rotated separately from the first ratchet gear so that the rotation of the second driving gear operates the second gear group but does not operate the first gear group.

5. A double-faced clock in accordance with claim 1, wherein said first and second driving gears are fixedly mounted on the first and second ends of the driving shaft, and said means comprises a sliding gear slidably inserted on a pin secured to the inner case of the second clock part which is always engaged with the second driving gear and selectively engaged with any gear of the second gear group when the sliding gear is moved outward, an actuating rod projected from the second clock part at its outer end which has a bevel gear engaging with the sliding gear at its inner end, a lever connected to the actuating rod at its end and disposed between the sliding gear and the inner case of the second clock part at its other end which is adapted to move the sliding gear outward when the actuating rod is pulled outward and a spring for biasing the sliding gear inward, whereby when the actuating rod is pulled outward and rotated, the sliding gear is moved outward to be disengaged from the any gear of the second gear group by the lever and rotated so that the rotation of the sliding gear rotates the second driving gear and thus operates the first gear group but does not operate the second gear group.

* * * * *